US011565876B1

(12) United States Patent
Murray et al.

(10) Patent No.: US 11,565,876 B1
(45) Date of Patent: Jan. 31, 2023

(54) SURFACE MOUNTED SECONDARY CONTAINMENT SYSTEM

(71) Applicant: Murray Services Inc., Calumet, OK (US)

(72) Inventors: Steven Allen Murray, Calumet, OK (US); Caleb Crick, Oklahoma City, OK (US)

(73) Assignee: Murray Services Inc, Calumet, OK (US)

( * ) Notice: Subject to any disclaimer, the term of this patent is extended or adjusted under 35 U.S.C. 154(b) by 18 days.

(21) Appl. No.: 17/393,127

(22) Filed: Aug. 3, 2021

Related U.S. Application Data

(63) Continuation of application No. 16/931,914, filed on Jul. 17, 2020, now Pat. No. 11,104,511, which is a continuation of application No. 15/999,405, filed on Aug. 20, 2018, now Pat. No. 10,745,195.

(60) Provisional application No. 62/548,284, filed on Aug. 21, 2017.

(51) Int. Cl.
*B65D 90/24* (2006.01)

(52) U.S. Cl.
CPC ..... *B65D 90/24* (2013.01)

(58) Field of Classification Search
CPC .... F17C 3/06; F17C 3/04; F17C 3/027; F17C 3/025; F17C 3/022; F17C 3/02; B65D 90/52; B65D 90/34; B65D 88/748; B65D 88/128; B65D 90/24; B65D 88/54; B65D 90/02; B65D 90/12
See application file for complete search history.

(56) References Cited

U.S. PATENT DOCUMENTS

| | | | | |
|---|---|---|---|---|
| 1,476,421 | A | 12/1923 | Rowland | |
| 1,983,355 | A | 12/1934 | Eschler | |
| 2,628,403 | A | 2/1953 | Garrison | |
| 2,777,295 | A | 1/1957 | Bliss | |
| 3,151,416 | A | 10/1964 | Eakin et al. | |
| 3,206,900 | A | 9/1965 | Doyle et al. | |
| 5,234,191 | A | 8/1993 | Bambacigno et al. | |
| 5,305,631 | A | 4/1994 | Whited et al. | |
| 6,116,815 | A * | 9/2000 | Chen | E02D 31/02 210/170.07 |
| 6,318,581 | B1 * | 11/2001 | Garton | B67D 7/0288 220/4.12 |
| 6,360,545 | B1 | 3/2002 | Goldstone et al. | |
| 6,474,496 | B1 | 11/2002 | Garton | |
| 6,634,676 | B1 * | 10/2003 | Lampson | B65D 90/24 285/123.17 |
| 2002/0020704 | A1 * | 2/2002 | Zacharias | A62C 3/0292 220/4.12 |
| 2002/0064425 | A1 * | 5/2002 | Stanton | B65D 90/24 405/53 |
| 2005/0205580 | A1 * | 9/2005 | Zais | B65D 90/24 220/567.1 |

(Continued)

*Primary Examiner* — Kareen K Thomas
(74) *Attorney, Agent, or Firm* — Phillips Murrah PC; Martin G. Ozinga

(57) ABSTRACT

The present invention comprises a surface mount secondary containment system comprising prefabricated pieces that may be assembled to form a wall and adjoining corner with overlapping sections to capture leaks, spillage or the like from a primary liquid container member that may be constructed so that no ground damage and or penetration is done during construction and use.

1 Claim, 5 Drawing Sheets

(56) References Cited

U.S. PATENT DOCUMENTS

| | | | | |
|---|---|---|---|---|
| 2006/0118563 | A1* | 6/2006 | Travis, II | B65D 90/24 220/565 |
| 2009/0134171 | A1* | 5/2009 | deBerardinis | B65D 90/24 220/23.91 |
| 2010/0230002 | A1* | 9/2010 | Huang | B67D 7/049 141/94 |
| 2010/0320727 | A1* | 12/2010 | Haut | B65D 88/128 280/423.1 |
| 2011/0067761 | A1* | 3/2011 | King | B65D 90/24 137/1 |
| 2011/0247956 | A1* | 10/2011 | Crager | B65D 90/54 206/524.6 |
| 2011/0265405 | A1* | 11/2011 | Ksenych | B65D 90/24 52/264 |
| 2011/0272413 | A1* | 11/2011 | Yaremenko | B65D 90/004 220/563 |
| 2012/0199508 | A1* | 8/2012 | Hebblethwaite | B65D 90/28 206/459.1 |
| 2013/0213969 | A1* | 8/2013 | Bain | B60K 15/03 220/500 |
| 2015/0096980 | A1* | 4/2015 | Laing | B65D 90/24 220/9.4 |
| 2015/0321834 | A1* | 11/2015 | Hughes | B65D 88/74 137/563 |
| 2017/0225884 | A1* | 8/2017 | McCoy | F16K 31/22 |

* cited by examiner

SURFACE MOUNTED SECONDARY CONTAINMENT SYSTEM

CROSS-REFERENCE TO RELATED APPLICATIONS

The present patent application is a continuation of U.S. patent application Ser. No. 16/931,914, filed Jul. 17, 2020, currently pending, which is a continuation of U.S. patent application Ser. No. 15/999,405, filed on Aug. 20, 2018, now U.S. Pat. No. 10,745,195, issued Aug. 18, 2020, which claims priority from U.S. Provisional Patent Application Ser. No. 62/548,284, filed on Aug. 21, 2017. The entire content of each of the above-referenced applications is hereby expressly incorporated herein by reference.

BACKGROUND OF THE INVENTION

1. Field of the Invention

In general, the present invention relates to an apparatus, system, and method of providing secondary containment in oil and gas operations such as but not limited to a tank battery. More particularly, the present invention provides a surface mount secondary containment system comprising prefabricated pieces that may be assembled to form a wall and adjoining corner with overlapping sections to capture leaks, spillage or the like from a primary liquid container member that may be utilized without damaging and or penetrating the ground. The current invention may further include a new and improved apparatus, system and method of securing a liner to the containment system and providing an integral support.

2. Description of the Prior Art

In the oil and gas industry, a major concern facing the industry is the ever growing and constant concern with environmental impact of oil and gas production coupled with the ever increasing need to maximize efficiency and recovery of natural resources associated therewith. Prior art methods that were perfectly acceptable just years ago are now politically and environmentally unfriendly. Whereas it was acceptable to allow by products from well production to be released onto the ground, it is not considered a viable environmentally sound method to date.

A secondary containment system provides an essential line of defense in the event of a failure of the primary containment, such as a tank, a bulk storage container, a mobile or portable container, piping, or oilfield equipment. These systems are designed to provide temporary containment of discharged oil and other pollutants until the appropriate actions are taken to abate the source of the discharge and remove the unwanted fluids from areas where it has accumulated to prevent it from polluting the environment.

Furthermore, in the oil and gas industry, the term "battery" generally refers to a group of containers called "tanks" that are a grouping of interconnected storage tanks situated to receive the output of one or more wells for crude oil production and or a producing lease. A tank battery is also called a battery. Typically, in the tank battery, the oil volume is measured and tested before pumping the oil into the pipeline system and the group of tanks at a well site are used to store oil prior to sale to a pipeline company. A typical tank battery contains one or more tanks and usually has a capacity equal to four days production.

Concern for environmental pollution has resulted in governmental requirements that certain sites such as tank batteries in the oil and gas industry provide a containment system also referred to as secondary containment to guard against leaking from the operation into the surroundings. For several liquids, federal, state and local regulations require double containment systems for the protection of groundwater. General secondary containment requirements apply to bulk storage containers, portable containers, production tank battery, treatment and separation installations, oilfield operational or process equipment and transfer activities.

The EPA suggests providing secondary containment by dikes, berms, or retaining walls, curbing or drip pans, sumps and collection systems, culverting, gutters, or other drainage systems, weirs, booms, or other barriers, spill diversion ponds, retention ponds and sorbent materials. Specific containment provisions apply to bulk storage containers, loading/unloading racks, single compartment of a tank car or tank truck at a loading/loading rack, mobile/portable bulk storage containers, as well as production tank batteries, treatment and separation installations.

It is also desirable to provide secondary containment for other oil and gas operations other than the above. By example, it is often desirable to provide a temporary containment system during the drilling process around whole location, during fracking around storage containers called frack tanks and so forth.

In the prior art, berms and other types of walls have been utilized to provide the needed secondary containment. However, these prior art systems typically require either moving dirt to create the berm or digging into the dirt to form a pillar system for placing wall panels against. It is not unusual for oil and gas companies to prefer a surface mount as opposed to the prior art devices to minimize ground disturbance. Surface mounts are preferred when the ground pad has been treated to create a solid surface that will inhibit the soaking-in of fluids; the ground pad may contain solid bed-rock as its base and installing the prior art metal secondary containment is labor intensive, time consuming and therefore cost prohibitive; the company's personal preference and so forth.

It is further desirable to provide a secondary containment system that does not need to be staked into the ground. In some applications, the secondary containment system is provided on a temporary basis such as a fracturing operation. Often at these types of operations, the ground is treated before operating where it is desirable to not disturb the ground by penetrating. It is also understood that it may be desirable to provide a secondary containment system where it may be utilized on concrete or other surfaces where it is extremely undesirable to break and or damage the surface during a temporary installation. Furthermore, it is desirable to provide a secondary containment system that reduces the amount of time and cost associated with staking.

It is still further desirable to improve the securing of a liner inside the containment system over the prior art. Due to the nature of the liners, it is not desirable to cut and or penetrate the material for obvious reasons. Therefore, it is desirable to provide a means to firmly secure the liner without damaging the liner.

It is obviously desirable to provide secondary containment in oil and gas operations in general and more specifically tank battery operations. The balance of cost, time and operational efficiency has created a need for a new and improved secondary containment system and method. Thus, there is a need for an apparatus, method and system that provides a secondary containment system for utilization in the oil and gas field as well as other applications where it is desirable to provide secondary containment that maximizes efficiency and is environmentally friendly. The current invention provides an inexpensive, time saving, more reliable apparatus, system and method where the prior art fails.

SUMMARY OF THE INVENTION

In view of the foregoing disadvantages inherent in the known types of secondary containment systems now present in the prior art, the present invention provides a new and improved apparatus, system and method of use, which may be quickly deployed and removed. As such, the general purpose of the present invention, which will be described subsequently in greater detail, is to provide a new and improved secondary containment system, which has all the advantages of the prior art devices and none of the disadvantages.

To attain this, the present invention essentially comprises a series of interconnectable members, which can be interlocked together to form virtually any desired containment perimeter and a liner such as but not limited to a sheet of flexible plastic material that may be laid over the containment area and extends across to the containment perimeter structure. The interconnectable members may generally be a wall section for forming overlapping walls and a corner section for connecting the walls also in an overlapping manner. The modular system may be screwed together forming a barrier and may include a liner disposed inside said containment perimeter. The current invention may be utilized in well operations, well production in general, drilling operations, tank batteries and so forth. The invention is generally designed to capture toxic and nontoxic fluids.

It is also contemplated to provide a bottom strap that connects at the base of the interconnectable members and may provide structural integrity to the containment system without need of staking same. It is still further contemplated to provide a retention bar for a liner trim hanger and or liner trim cap for securing the liner over the top of interconnectable members.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved secondary containment apparatus, system, and method of using the same that provides easy installation with virtually no training necessary, allows for quick installation because of the one primary component, which can be critical in harsh weather conditions, provides dimension diversity, as well as provides panels that may be galvanized and powder coated steel in the customer's color of choice.

Still another object of the present invention is to provide a new and improved secondary containment apparatus, system, and method of using the same, which may be easily and efficiently transported to the desired site, deployed, and removed as desired.

It is a further object of the present invention to provide a new and improved secondary containment apparatus, system, and method of using the same, which is of a durable and reliable construction and may be utilized with multiple applications.

An even further object of the present invention is to provide a new and improved secondary containment apparatus, system, and method of using the same, which is susceptible to a low cost of manufacture with regard to both materials and labor, and which accordingly is then susceptible to low prices of sale to the consuming industry, thereby making such economically available to those in the field.

Still another object of the present invention is to provide a new and improved secondary containment apparatus, system, and method of using the same, which provides all of the advantages of the prior art, while simultaneously overcoming some of the disadvantages normally associated therewith.

Another object of the present invention is to provide a new and improved secondary containment apparatus, system, and method of using the same that is environmentally friendly while practical.

Yet another object of the present invention is to provide a new and improved secondary containment apparatus, system, and method of using the same that may be trailered by trucks into hard to reach areas and deployed without large equipment such as forklifts.

An even further object of the present invention is to provide a new and improved secondary containment apparatus, system, and method of using the same and is transportable along existing highways without special provisions.

An even further object of the present invention is to provide a new and improved secondary containment apparatus, system, and method of using the same, which provides overlapping panels and is completely customizable.

Still another object of the present invention is to provide a new and improved secondary containment apparatus, system, and method of using the same, which is generally safer since large equipment is not needed onsite for the installation.

It is a further object of the present invention to provide a new and improved secondary containment apparatus, system, and method of using the same that provides for a non-ground penetrating option that may not damage and or disturb the surface wherein the containment system is deployed.

Yet another object of the present invention is to provide a new and improved secondary containment apparatus, system, and method of using the same that provides for securely attaching a liner to the containment system without cutting holes and or damaging the liner and still securing it by utilizing a retainer bar for the liner trim cap and or liner trim hangers.

These, together with other objects of the invention, along with the various features of novelty, which characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there are illustrated preferred embodiments of the invention.

BRIEF DESCRIPTION OF THE PICTORIAL ILLUSTRATIONS, GRAPHS, DRAWINGS, AND APPENDICES

The invention will be better understood and objects other than those set forth above will become apparent when consideration is given to the following detailed description thereof. Such description makes reference to the annexed pictorial illustrations, graphs, drawings and appendices wherein.

DETAILED DESCRIPTION OF THE PREFERRED EMBODIMENTS

Figure 1:
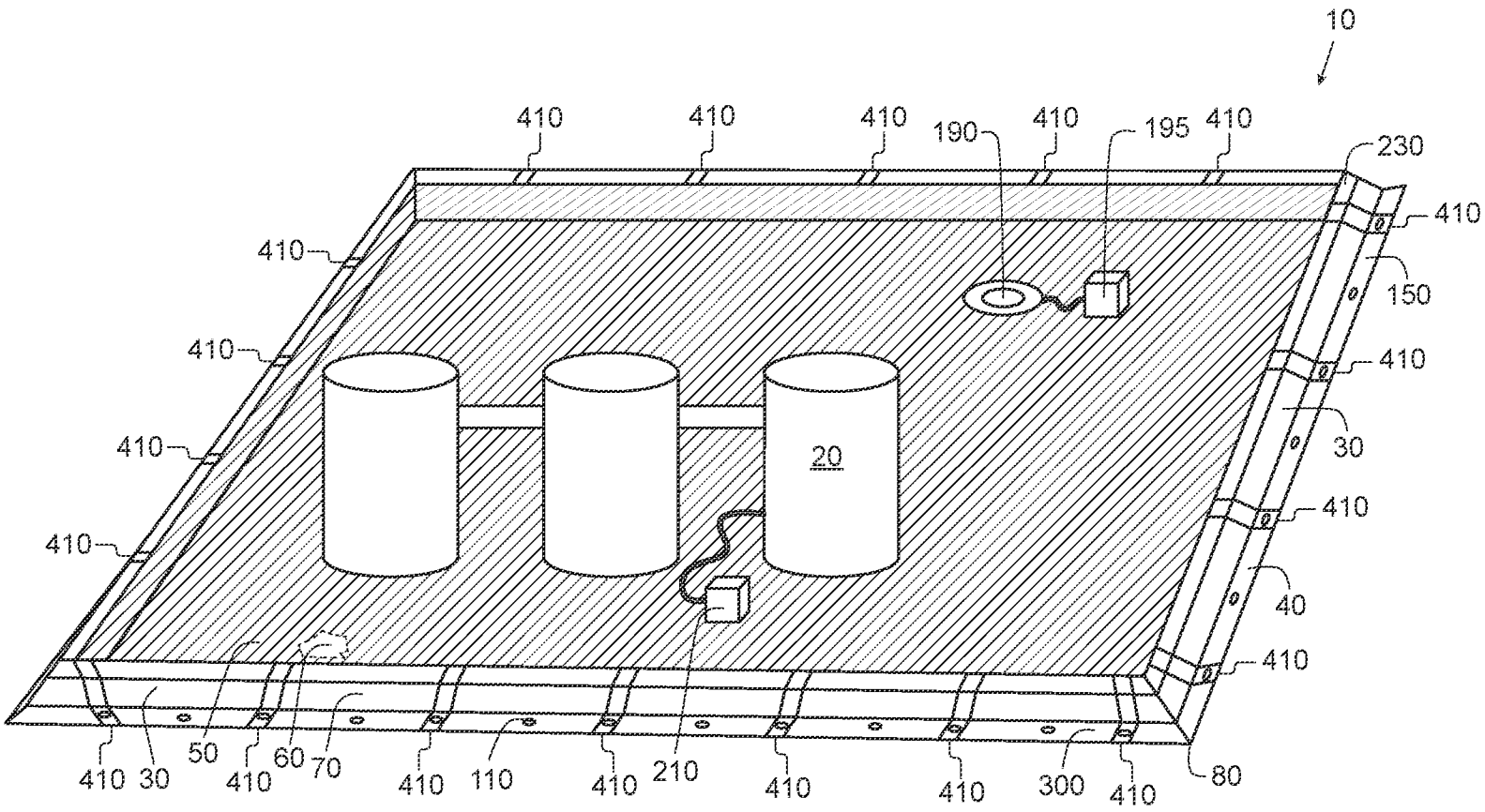
FIG. 1 is a general perspective view illustration of a preferred embodiment of the invention with a tank battery depicted.
Figure 2:
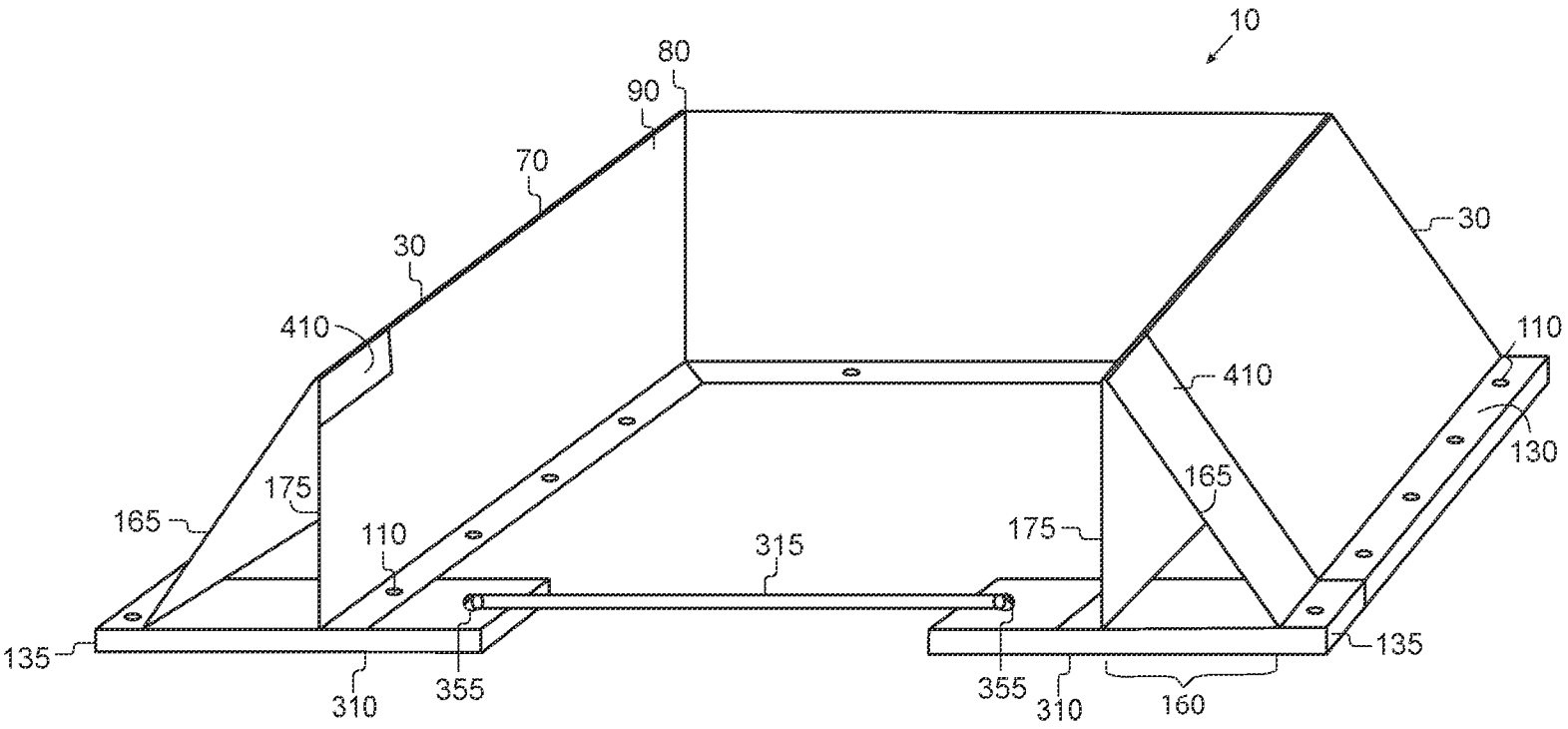
FIG. 2 is a general perspective view partial illustration of a preferred embodiment of the invention without a liner and is a representative sketch of the various components.

Referring to the illustrations, and to FIG. 1 in particular, reference character 10 generally designates a new and improved secondary containment apparatus, system, and method of using same constructed in accordance with the present invention. Invention 10 is generally used with a tank battery 20 where it is desirable to provide a containment system that can capture the water, oil, debris, chemicals and so forth resulting from an oil and gas operation and tank battery 20 installation. It is understood that invention 10 may be utilized in numerous other applications where it is desirable to provide a containment system and the current invention should not be considered limited to just oil and gas applications. It is, therefore, understood that the current invention may be utilized with multiple applications and the current disclosure should not be considered the invention to such.

Again referring to the illustrations, FIG. 1 generally shows rudimentary tank battery 20 of three tanks for accommodating an environmentally sensitive and potentially hazardous liquid such as petroleum or various other types of chemicals. Most commonly, such tanks are utilized to hold petroleum and assorted types of hydrocarbon fuels. Potentially hazardous chemicals are also stored in aboveground tanks of this type. Although the typical tank has a generally cylindrical configuration, the particular size, shape, construction and type of tank are not limitations of this invention. The version depicted is for illustrative purposes only and is not intended to accurately depict all the elements associated with tank battery 20. It should be understood that various alternative tank constructions may be utilized within the scope of this invention. It should also be understood that various types of liquids may be accommodated within and or associated with tank battery 20.

Invention 10 may generally include modular section that may be a series of interconnectable members 30, which can be interlocked together to form virtually any desired containment perimeter and or wall 40. A liner 50 such as but not limited to a sheet of flexible plastic material may be laid over containment area 60 and extends across to the containment perimeter 40 structure. It is contemplated to provide a protective substrate and or layer underneath liner 50 such as but not limited to felt 55 (not shown).

In a preferred construction, interconnectable members 30 may generally have a triangular cross section as depicted. It is understood that numerous cross section designs are contemplated as will be discussed further below. Interconnectable members 30 may be made from but not limited to a galvanized sheet metal steel of numerous thicknesses, gauges and so forth. The invention further contemplates materials such as but not limited to aluminum, plastic, composite materials, combinations thereof and so forth. It is understood that the angle and construction generally add strength to the design as known in the art for containment of fluids as needed.

Interconnectable members 30 may be generally a wall section 70 having a top 75 as generally depicted. It is understood that other shapes may be utilized such as rounded corners and sections for more oval and or circular sections or types of containment perimeter 40.

Invention 10 wall section 70 may be of numerous lengths with a preferred embodiment being 10'4" wherein first end 90 and second end 100 may respectively include but is not limited to a 4" section for overlapping and generally connecting to other members 30 such that a 10' non-overlapping section is created. It is also contemplated that wall section 70 and corner section 80 may be but is not limited to 15" to 26" in height. Wall section 70 and corner section 80 may include apertures 110 for securing screws, stakes, bolts or other types of fastening devices where corner sections 80 overlap and generally secure to the ground and or base. Wall section 70 and corner section 80 may still further include an inner first flat portion 120 and an outer second flat portion 130 where apertures 110 may be located. Inner first flat portion 120 may include a lip 125 and outer second flat portion 130 may also include a lip 135 which may be ½" in length although lesser and or greater lengths are contemplate. It is understood that corner section 80 may not include inner first flat portion 120, outer second flat portion 130, lip 125, lip 135 and so forth.

Inner first flat portion 120 may further comprise anchor 140 and outer second flat portion 130 may further comprise anchor 150 for additional structural integrity, securing into the ground, slip prevention, combinations thereof, and so forth. Interconnectable members 30 cross section 160 are not limited to just the illustrations. It is contemplated that width 170 of cross section 160 may generally be the same as height 180 of cross section 160.

It is also contemplated that cross section 160 may generally include an angle portion 165 and a perpendicular portion 175. It is contemplated that perpendicular portion 175 may be generally located to be on the inside of containment perimeter 40 and 45 degree angle portion 165 on the outside of containment perimeter 40 as generally depicted. It is to be understood that the figures are for illustrative purposes to generally depict how member 30 may be aligned to containment perimeter 40 and is not intended to be limiting or inclusive. It is also to be understood that the perpendicular portion 175 may be put on the outside for a different configuration. Furthermore, it is to be understood that angle portion 165 may be of numerous angles other than that depicted. Still furthermore, perpendicular portion 175 may or may not be perpendicular and numerous other angles are also contemplated.

Liner 50 may be secured as known in the art to containment perimeter 40. Liner 50 such as but not limited to a sheet of flexible plastic material may be laid over the containment area 60 and extends across to the containment perimeter 40 structure. Liner 50 may be but is not limited to water resistant material, reinforced PVC or urethane, a copolymer, combinations thereof and so forth. Liner 50 may be secured to the top of the containment perimeter 40 structure or otherwise. Liner 50 is preferably an impermeable material that may be adapted and or configured to cover the ground between tank battery 20 and containment perimeter 40. It is also contemplated to provide liner 50 underneath tank battery 20 and installed before placing tank battery 20.

Invention 10 may further include at least one drain 190 formed through liner 50 and or felt 55 and into the underlying ground or other desired location. A hydrocarbon sensor and containment valve system 195 may monitor the presence of petroleum in drain 190 wherein system 195 may respond to the presence of petroleum in drain 190 by closing drain 190 to prevent discharge of petroleum from containment area 60, but still allow clean water to drain out of containment area 60.

Invention 10 also contemplates other known means for removing accumulated fluid from containment area 60 such as but not limited to providing a sump pump 210 that may drain containment area 60 and transfer the fluid back to a tank and or container in tank battery 20.

Non-Ground Penetrating System

Invention 10 may include a non-ground penetrating containment system 300, which may provide a bottom strap 310 having a first end 320 having a first attachment point 330, a first length 340, a second attachment point 350 a second length 360 and a second end 370. It is understood that first attachment point 330 may connect with either wall section 70 and or corner section 80 and may have inner first flat portion 120 and outer second flat portion 130 apertures 110. It is understood that the system may still penetrate the ground if desired.

Figure 3:
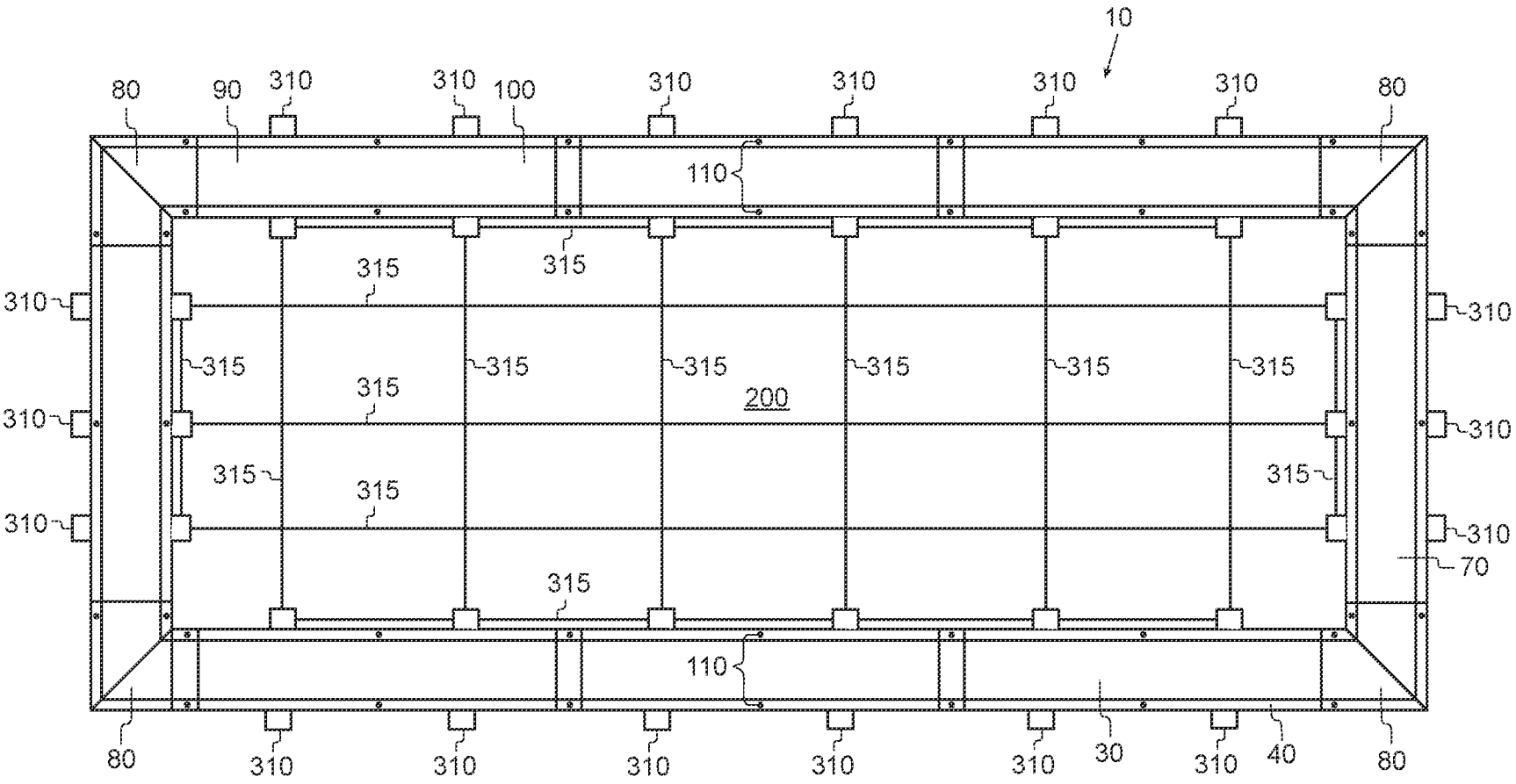
FIG. 3 is a general top view illustration of a preferred embodiment without a liner, a trim cap liner hanger or a retention bar and generally depicts bottom straps attached and interconnected with wire.
Figure 4:
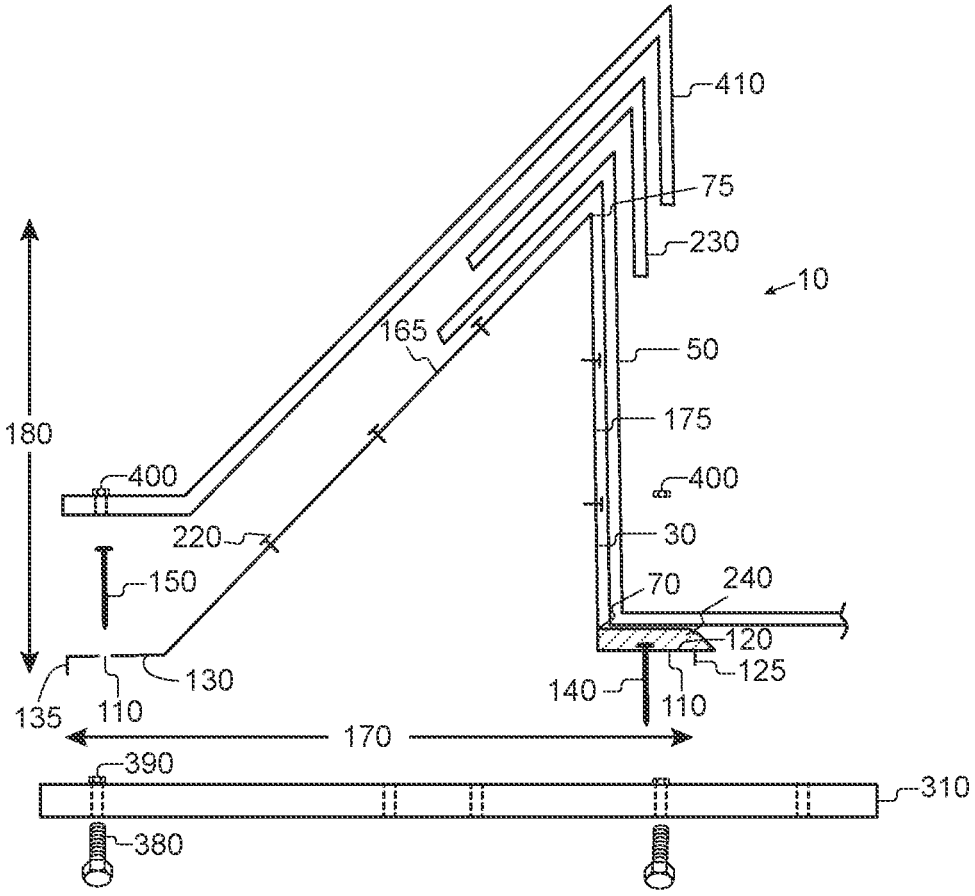
FIG. 4 is a general cross sectional exploded illustration of a preferred embodiment of the invention with retention bar, trim cap liner hanger, liner, and interconnectable member
Figure 5:
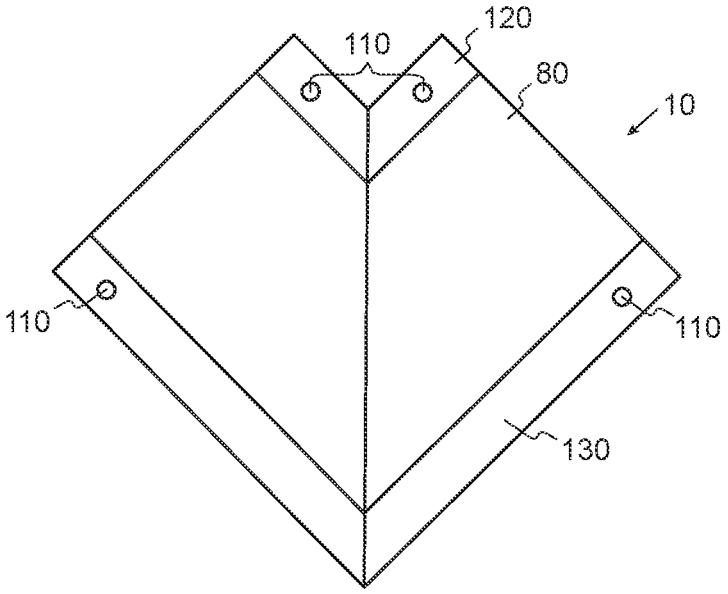
FIG. 5 is a general top view illustration of a preferred embodiment of the invention depicting a corner.
Figure 6:
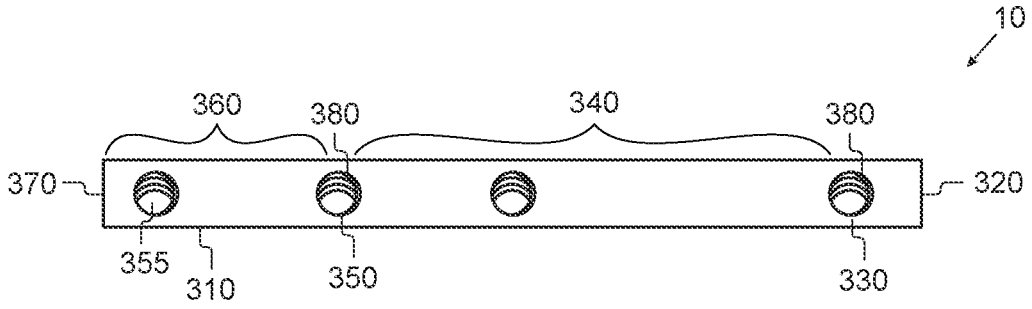
FIG. 6 is a general top view illustration of a preferred embodiment of the invention depicting a bottom strap.
Figure 7:
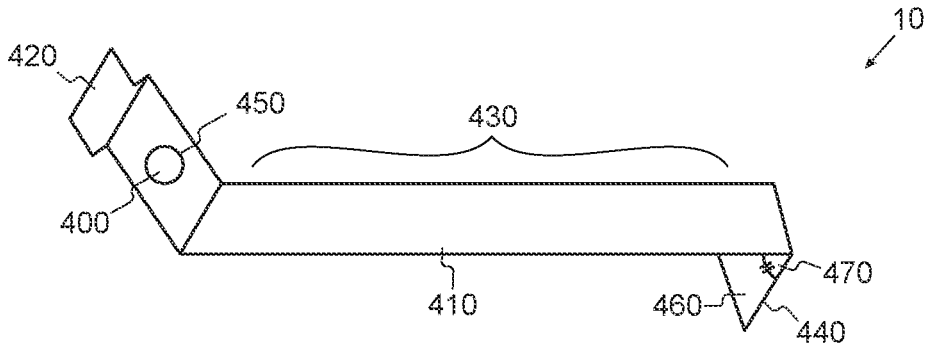
FIG. 7 is a general perspective view illustration of a preferred embodiment of the invention depicting a retention bar.
Figure 8:
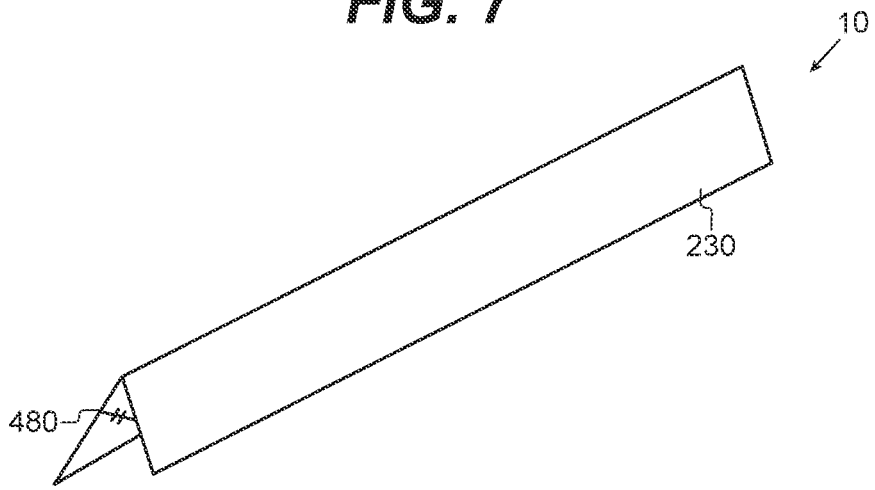
FIG. 8 is a general perspective view illustration of a preferred embodiment of the invention depicting a trim cap liner hanger.

Bottom strap 310 may include aperture 355, which may be utilized to connect with cable 315. It is contemplated to crisscross from bottom strap 310 to other bottom strap 310 as generally depicted in FIG. 3. This may provide structural integrity if it is decided to not stake down, partially stake down, or even when staking down.

It is also contemplated that second length 360 may extend into the containment area 60 wherein any weight of fluid may act as a means to weigh down containment system 300 and provide more integrity. It is understood that second length 360 may be longer, shorter, and of numerous configurations and shapes.

It is contemplated to provide a flat bottom surface for interconnectable members 30. It is understood that wall section 70 and corner section 80 may not have lip 125 and lip 135.

First attachment point 330 and second attachment point 350 may be but is not limited to a bolt 380 that may be welded into bottom strap 310 that may then be located in apertures 110 with a washer 390 and nut 400.

It is also contemplated that trim cap liner hanger 230 may be secured by other means than screws. Invention 10 may include retention bar 410 that may secure trim cap liner hanger 230 over the top of interconnectable members 30 and trapping the liner 50 in place. Retention bar 410 may have a first end with a first attachment point 420, a length 430, and second attachment point 440. Retention bar 410 first attachment point 420 may be an aperture 450, which may be utilized to connect to interconnectable members 30 via strap 310 first attachment point 330 bolt 380 and secured via washer 390 and nut 400. It is understood that retention bar 410 may be secured in other ways and the invention should not be limited to same.

Retention bar 410 second attachment point 440 may include hook 460 with angle 470 wherein angle 470 corresponds to which may be the same as cap liner hanger 230 angle 480. It is contemplated that hook 460 of retention bar 410 is adapted to snuggly fit cap liner hanger 230 angle 480 wherein cap liner hanger 230 is firmly secured.

It is therefore contemplated that invention 10 may provide a non ground penetrating secondary containment system for containing fluids around oil and gas operations in a designated containment area defined by a containment perimeter comprising: a wall around said containment perimeter wherein said wall comprises a top, at least one rigid section having a first end, a second end, a length between said first end and said second end, an inner flat portion with apertures running said length, a generally perpendicular portion running said length attached to said inner flat portion, an angled portion running said length attached to said generally perpendicular portion wherein said generally perpendicular portion and said angled portion form two sides of a triangle, an outer flat portion with apertures running said length attached to said angled portion; at least two bottom straps having a first end with a first aperture adapted to be secured to said apertures of said inner flat portion, a second end with a second aperture, and a length with a third aperture adapted to be secured to said apertures of said outer flat portion; a water resistant plastic liner adapted to cover said containment area, said generally perpendicular portion and said top of said wall; a trim cap liner hanger adapted to trap said liner against said top of said wall, at least two retention bars having a first end aperture adapted to secure to said apertures of said outer flat portion and a second end adapted to secure said trim cap liner hanger to said top of said wall; wherein said secondary containment system is non ground penetrating; and wherein said second apertures of said second end of said at least two bottom straps are connected via cable for adding structural integrity to said containment system.

IN OPERATION

Invention 10 contemplates that the modular nature of members 30 lend to an easy to install and variable containment perimeter 40 as desired. The assembly is not pre-assembled, but is instead assembled and installed on site. To assemble and create containment area 60 on site, liner 50 may be located first on surface 200 before members 30 are formed into containment perimeter 40 although it is understood that containment perimeter 40 may be located before liner 50 is positioned on surface 200.

Members 30 may be placed in an overlapping configuration and fastened together with screws through corresponding and lined up apertures 110. It is contemplated that wall section 70 may generally create the width and length of containment perimeter 40 and be joined at corners by corner sections 80.

In a preferred embodiment, liner 50 is placed after containment perimeter 40 is positioned and liner 50 is secured to member 30 by clamps, screws and other known fastening devices. It is understood that liner 50 may be secured to members 30 at the top of member 30, over the top, along the back or outer side or along the inner side.

Still further, in a preferred embodiment, invention 10 may include the steps:

1. Building a level screenings or sand based pad such as but not limited to 10' larger than the planned containment perimeter 40 and or containment areas 60. The screenings base may be but is not limited to from 3"-6" in height. It may be recommended to have extra screenings onsite to level any final areas that are off. It is known to be critical to have a level surface for setting tanks in later such as but not limited to tank battery 20.

2. Laying out where the containment perimeter 40 will go with stakes and a string line and marking the width and length 8" smaller than the desired containment perimeter 40 to account for the added 4" of inner first flat portion 120. This string line should be run along the inside bottom of member 30 wall section 70 just above the ground. It is understood that inner first flat portion 120 may be more or less than 4" and staking should be relative to the width.

3. Cutting 4" of the members 30 wall section 70 panel of inner first flat portion 120 on the inside corner for overlapping and laying flush. This may be accomplished with heavy duty metal snips. It is also understood that the cutting may be more or less than 4". It is also contemplated this may be accomplished in the manufacturing process and therefore not required in the field.

4. Installing the containment perimeter 40 by setting members 30 wall section 70 along a long side and lining up the bottom inside of the member 30 wall sections 70 with a string line and then staking inner first flat portion 120 with anchor 140 through apertures 110.

5. Installing corner section 80 before installing outside outer second flat portion 130 with anchor 150. This may allow to push and pull the surface mount member 30 wall section 70 in order to get the desired height and straight line. It is understood that anchor 150 may not be utilized if strap 310 is utilized.

6. Getting a second string line going on the highest point of installed members 30 wall section 70 and using this string line as a guide to adjust the outer second flat portion 130 anchor 150 to keep the wall straight and level. It is contemplated that some slight pushing and pulling of each member wall section 70 to keep it going straight and level while securing anchor 150 on the outside stakes with outer second flat portion 130 apertures 110. Once again, it is understood that anchor 150 may not be utilized if strap 310 is utilized.

7. Installing self-tapping screws 220 into the overlapping member 30 wall sections 70 such as but not limited to a preferred embodiment being two screws 220 on the inside and three screws 220 on the outside evenly spaced approximately 6" apart around containment perimeter 60. It is contemplated to not screw at the top because of trim cap liner hanger 230 that may be installed later. It is also contemplated to construct without screws.

8. Once the containment perimeter 40 is all the way up and secured, it is contemplated to cover the inside of the members 30 wall section 70 with screenings 240. It is contemplated that before laying felt 55 and or liner 50, screening 240 such as but not limited to sand, fine gravel, dirt, small rocks, combinations thereof and so forth such that sharp edges of members 30, anchors 140 and or 150 are covered. This may also be utilized to fill in the corners for a better laying down of felt 55 and or liner 50.

9. Leveling the containment area 60 area again.

10. Laying out felt 55 under where liner 50 may be. This may include covering sharp edges of member 30 and inner first flat portion 120 and associated anchors 140 and or 150.

11. Laying liner 50 and push into position with care not to damage liner 50. Folding liner 50 corners where there are no wrinkles in liner 50 and the sides are all generally straight up and down.

12. Installing liner 50 anchors such as but not limited to sand tubes, concrete tread steps, and so forth, around the edges of the containment perimeter 40.

13. Pulling liner 50 over containment perimeter 40 and installing the trim cap liner hanger 230 with self-tapping screws 220 every 24". It is also contemplated to construct without screws and it is understood that greater and lesser lengths are contemplated. To install trim cap liner hanger 230, start one end, push liner 50 into place, then screw from the outside, then go to the other end and do the same thing, and then go back and fill in at 24" spacing. It is understood that greater and lesser lengths are contemplated as well as spacing and or procedures. It is also understood that retention bar 410 may be utilized wherein it is installed instead of or in conjunction with screws 220.

14. Cutting excess liner 50 with but not limited to a box blade using trim cap liner hanger 230 as a guide.

15. Visually inspecting liner 50 to ensure there are no holes before placing any equipment inside the containment area 60 and or containment perimeter 40.

It is also contemplated to spread the screenings 240 over the lip to cushion edges of liner 50 and further block air from getting inside or under liner 50. Cattle Panels Fencing—install hat channel every 5' and screw panels with a u bracket to the hat channel; and or hog ring panels together on each end as you overlap them by about 4". It is also contemplated for a wall over 100' long to build three sides of wall and leave one side open for placing felt 55 and liner 50 into position.

Changes may be made in the combinations, operations, and arrangements of the various parts and elements described herein without departing from the spirit and scope of the invention.

What is claimed is:

1. A non ground penetrating secondary containment system for containing fluids around oil and gas operations in a designated containment area defined by a containment perimeter comprising:

a wall around said containment perimeter wherein said wall comprises a top, at least one rigid section having a first end, a second end, a length between said first end and said second end, an inner flat portion with apertures running said length, an upright portion running said length attached to said inner flat portion, an angled portion running said length attached to said upright portion wherein said upright portion and said angled portion form two sides of a triangle, an outer flat portion with apertures running said length attached to said angled portion;

at least two bottom straps having a first end with a first aperture adapted to be secured to said apertures of said inner flat portion, a second end with a second aperture, and a length with a third aperture adapted to be secured to said apertures of said outer flat portion;

a water resistant plastic liner adapted to cover said containment area, said generally perpendicular portion and said top of said wall a trim cap liner hanger adapted to trap said liner against said top of said wall, at least two retention bars having a first end aperture adapted to secure to said apertures of said outer flat portion and a second end adapted to secure said trim cap liner hanger to said top of said wall;

wherein said secondary containment system is non ground penetrating; and wherein said second apertures of said second end of said at least two bottom straps are connected via cable for adding structural integrity to said containment system.

* * * * *